US006899284B1

(12) United States Patent
Böcking

(10) Patent No.: US 6,899,284 B1
(45) Date of Patent: May 31, 2005

(54) FUEL-INJECTION VALVE

(75) Inventor: Friedrich Böcking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/433,520

(22) PCT Filed: Aug. 29, 2002

(86) PCT No.: PCT/DE02/03171

§ 371 (c)(1),
(2), (4) Date: Feb. 26, 2004

(87) PCT Pub. No.: WO03/033904

PCT Pub. Date: Apr. 24, 2003

(30) Foreign Application Priority Data

Oct. 10, 2001 (DE) ..... 101 49 914

(51) Int. Cl.[7] ..... B05B 1/08
(52) U.S. Cl. ..... 239/102.2; 239/397.5; 239/584
(58) Field of Search ..... 239/102.1, 102.2, 239/75, 397.5, 584; 251/57, 129.06

(56) References Cited

U.S. PATENT DOCUMENTS 4,284,263 A 8/1981 Newcomb
4,669,660 A * 6/1987 Weber et al. ..... 239/102.2
4,739,929 A * 4/1988 Brandner et al. ..... 239/102.2
6,085,990 A * 7/2000 Augustin ..... 239/397.5
6,422,482 B1 * 7/2002 Stier et al. ..... 239/397.5

FOREIGN PATENT DOCUMENTS

| | | |
|---|---|---|
| DE | 195 38 791 | 4/1997 |
| DE | 199 09 106 | 9/2000 |
| DE | 199 40 056 | 3/2001 |
| DE | 199 40 055 | 4/2001 |
| EP | 0 869 278 | 10/1998 |
| JP | 62 243964 | 4/1988 |

* cited by examiner

*Primary Examiner*—Steven J. Ganey
(74) *Attorney, Agent, or Firm*—Kenyon & Kenyon

(57) ABSTRACT

A fuel injector has an actuator which is situated in an actuator housing connected by force-locking to a valve member at an end on the valve-needle side. The actuator is braced on the end of the actuator housing which is opposite thereto. A compensation section of the actuator housing is made of a material having virtually no, or having negative, temperature expansion, so that the temperature expansion of the actuator housing and the valve member, in the sequence up to a valve-sealing seat, essentially corresponds to the temperature expansion of the actuator and transmission elements situated up to the valve-sealing seat. The actuator housing is surrounded radially on the outside by a fuel chamber through which fuel flows.

6 Claims, 1 Drawing Sheet

FUEL-INJECTION VALVE

BACKGROUND INFORMATION

From European Patent No. EP 0 869 278, a fuel injector with a controllable actuator is known which is inserted in an actuator housing which is fixedly connected to a valve member. The actuator is in operative connection with a valve needle. Formed on the valve needle is a valve-closure member which cooperates with a valve-seat surface to form a valve-sealing seat. The material of the actuator housing has a thermal expansion coefficient which is nearly equal to the thermal expansion coefficient of the piezoelectric actuator. The actuator housing is inserted in a recess of the valve member and screw fitted to the valve member via a flange which is situated approximately in the middle of the longitudinal extension of the actuator housing. The temperature-related expansion of the actuator and the transmission elements up to the valve-closure member corresponds to the temperature-related expansion of the valve member and the actuator-housing segment, from the flange up to an end element on which the actuator is braced.

Disadvantageous in the described related art is that it is difficult to achieve a sufficiently precise temperature compensation. The temperature expansion is only approximately linear, and the employed piezoceramics of the actuator in part have negative temperature expansion coefficients. Furthermore, it is disadvantageous that relatively large quantities of expensive special materials, such as invar, are required. Also, the actuator housing is not effective for temperature compensation in its entire length, but only between the flange and a contact surface of the actuator.

SUMMARY OF THE INVENTION

The fuel injector according to the present invention has the advantage over the related art that the temperature expansion, which is already minimized by the compensation section, is further reduced as a result of the cooling. Since newly entering fuel flows over the surface of the actuator housing and the actuator accommodated therein, an operating temperature comes about which, compared to the related art, is elevated by only a low value relative to the initial temperature. Since the deviation is very slight compared to the cold state, the tolerances and play may be optimized to the warm operating state. Furthermore, the multi-part design of the actuator housing requires only small quantities of special materials. The entire compensation section is used for expansion compensation.

In an advantageous embodiment, a flexurally soft membrane seals an actuator chamber, bounded by the actuator housing, at its end on the valve-needle side from a second fuel chamber. The second fuel chamber is acted upon by fuel-inflow pressure, and the actuator chamber is filled with an hydraulic fluid, so that sealing problems are avoided. The membrane separates the actuator chamber and the second fuel chamber in which the same pressure prevails. Due to the elasticity of the membrane, the membrane is deformed until pressure parity exists. Furthermore, due to the elasticity, the membrane is able to follow the movement of a transmission element penetrating the membrane for a lift movement, without a sliding, movable sealing line being required.

Advantageously, the membrane is a corrugated tube which is sealingly connected to an actuator tappet at one side and to the actuator housing on the other side. A corrugated tube allows an expansion in its longitudinal axis, which is the direction of the lift movement, in a very wide path range.

The hydraulic fluid can be a silicon oil. Silicon oil has good chemical compatibility with the piezoceramics of the actuator and may be optimized very well with regard to desired gliding characteristics and viscosity.

In an advantageous manner, the actuator is braced against the actuator housing via a support element, and an upper membrane sealingly separates third combustion chamber, which is under fuel-inflow pressure, inside the actuator housing, the third fuel chamber being in connection with the first fuel chamber. In this way, the overall area of the elastic membranes, which effect the pressure compensation by deforming, is enlarged and the required pointwise deformation reduced, thereby increasing the service life of the membranes.

The compensation section is advantageously made of invar. Invar, i.e. an alloy of nickel and iron, has the desired properties and is in good supply.

DETAILED DESCRIPTION

Figure 1:
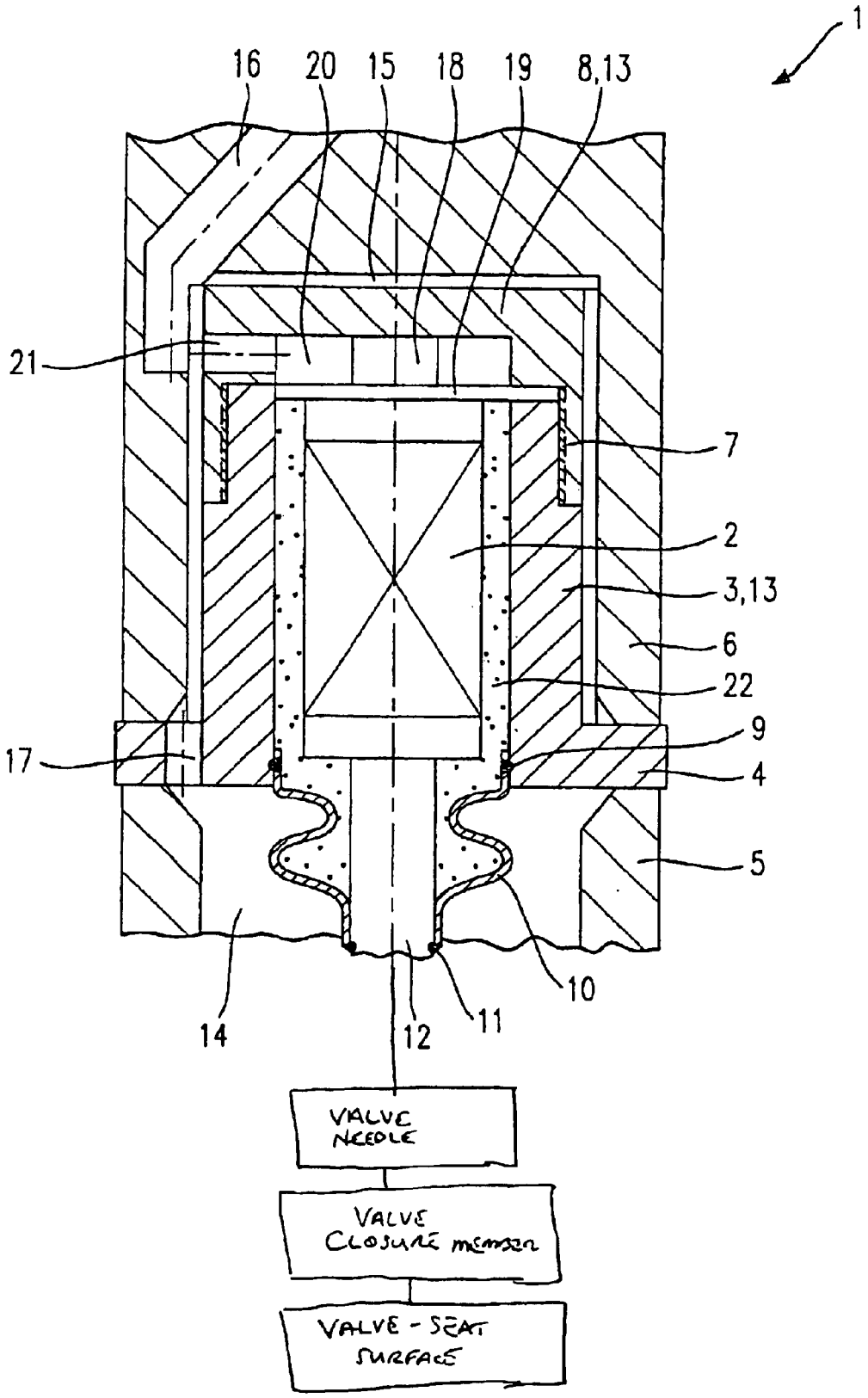
FIG. 1 shows a schematic section through an exemplary embodiment of a fuel injector configured according to the present invention, in the region of an actuator.

FIG. 1 shows a schematic section through an exemplary embodiment of a fuel injector 1 configured according to the present invention, in the region of an actuator 2. Actuator 2 is surrounded by a cylinder-shaped compensation section 3 which is connected to a lower valve member 5 and to an upper valve member 6 by way of a flange 4. Using a thread 7, an end 8 is screwed onto compensation section 3. A corrugated tube 10 is sealingly connected to compensation section 3 via a welding seam 9, and to an actuator tappet 12 resting against actuator 2 via a second welding seam 11. Compensation section 3 and end 8 together form an actuator housing 13, which is sealed from a second fuel chamber 14 by corrugated tube 10.

Inside actuator housing 13 is an actuator chamber 15. Over a large part of its surface, actuator housing 13 is surrounded by a first fuel chamber 15 which is delimited toward the outside by upper valve-member section 6. Via a fuel-inflow bore 16, inflowing fuel fills first fuel chamber 15 which is under the pressure of the inflowing fuel. Fuel from first fuel chamber 15 can reach second fuel chamber 14 via a connecting bore 17 in flange 4 of compensation section 3. If a plurality of such connecting bores 17 is distributed over the circumference of flange 4, the fuel enters second fuel chamber 14 from first fuel chamber 15 in such a way that it is evenly distributed over the circumference. As a result, the fuel entering fuel injector 1 via fuel-inlet bore 16 flows around a large part of the surface of actuator housing 13 in an even manner and cools this housing.

Actuator 2 is braced on end 8 of actuator housing 13 via a support element 18. By a second membrane 19, a third fuel chamber 20 in the upper region of actuator housing 13 is separated from actuator chamber 15. Third fuel chamber 20 is in connection with first fuel chamber 15 by way of a connecting bore 21. In this way, third fuel chamber 20 is filled with fuel which is under the same pressure as the fuel in fuel chamber 15. If a plurality of such connecting bores is distributed over the radial area of end 8, it is possible here, too, to achieve a flow through third fuel chamber 20, with the attendant cooling effect on actuator chamber 15 via the surface of membrane 19. Actuator chamber 22 is preferably filled with a silicon oil.

If an electric voltage is applied to actuator 2 via control lines (not shown here), it expands and, via actuator tappet 12, transmits a lift movement to additional connection elements (not shown here), up to a valve-sealing seat. Fuel injector 1 is a fuel injector having a valve needle that open to the outside. Therefore, in the drawing at hand, the opening movement is downward. Corrugated tube 10 elastically follows the lift movement and, due to welding seams 9 and 11, no sliding sealing edges are required. The pressure in actuator chamber 22, third fuel chamber 20 and second fuel chamber 14 as well is always equal since second membrane 19 and corrugated tube 10 always deform in such a way that pressure compensation takes place. The deformation path is advantageously reduced overall in that a large surface area of second membrane 19 and corrugated tube 10 are able to deform elastically.

When the voltage applied to actuator 2 drops, the valve needle is pressed back into its original position by a valve spring (not shown) and transmits this movement to actuator tappet 12 which compresses actuator 2 to its original length against support element 18 and end 8.

Following the initial operation of fuel injector 1, it heats up during the further operation. In doing so, a new overall length of actuator 2, actuator tappet 12 and additional transmission elements up to the valve sealing seat comes about, due to temperature expansions of the components that successively follow each other. On the other hand, due to the warming as well, a new overall length of the successively following components of lower valve member 5 and compensation section 3 of actuator housing 13 results. When the material properties of compensation section 3, preferably the invar material, and the length of the compensation element are appropriately selected, the temperature expansions correspond to each other overall and the pressing in the valve-sealing seat and the sealing effect remain the same or are maintained. Due to the cooling by inflowing fuel in first fuel chamber 15, which surrounds actuator housing 13 in a planar manner, the temperature difference between cold and operation-warm is kept low, and the temperature compensation optimized. The filling with silicon oil prevents the piezoceramics of actuator 2 from being damaged by the fuel, reduces possible friction of the actuator with respect to the inner walls of actuator housing 13 and, in particular, facilitates the heat conduction from actuator 2 to actuator housing 13 and further to the cooling fuel in first fuel chamber 15.

What is claimed is:

1. A fuel injector for a fuel-injection system of an internal combustion engine comprising:

a valve needle;

a valve-seat surface;

a valve-closure member connected to the valve needle, the valve-closure member cooperating with the valve-seat surface to form a valve-sealing seat;

a valve member;

an actuator housing which, at a first end on a valve-needle side, is connected to the valve member by force-locking, the actuator housing having a compensation section composed of a material having one of: (a) substantially no and (b) negative temperature expansion, so that a temperature expansion of the actuator housing and the valve member, in a sequence up to the valve-sealing seat, substantially corresponds to a temperature expansion of the actuator and transmission elements situated up to the valve-sealing seat;

an actuator for actuating the valve needle, the actuator being situated in the actuator housing, the actuator being supported at a second end of the actuator housing which is opposite to the first end, the actuator being one of a piezoelectric actuator and a magnetostrictive actuator; and a first fuel chamber through which fuel flows, the first fuel chamber radially surrounding the actuator housing on the outside.

2. The fuel injector according to claim 1, further comprising a second fuel chamber and an actuator chamber bounded by the actuator housing, the actuator chamber being sealed at an end on the valve-needle side by a flexurally soft first membrane from the second fuel chamber which is under fuel-inflow pressure, the actuator chamber being filled with an hydraulic fluid.

3. The fuel injector according to claim 2, further comprising an actuator tappet, and wherein the membrane includes a corrugated tube which is sealingly connected to the actuator tappet on a first side and to the actuator housing on a second side.

4. The fuel injector according to claim 2, wherein the hydraulic fluid includes a silicon oil.

5. The fuel injector according to claim 2, further comprising a support element bracing the actuator on the actuator housing, a third fuel chamber, and a second membrane sealingly separating the third fuel chamber, which is under fuel-inflow pressure, inside the actuator housing, the third fuel chamber being in connection with the first fuel chamber.

6. The fuel injector according to claim 1, wherein the compensation section is composed of invar.

* * * * *